US009835973B2

(12) United States Patent
Goto et al.

(10) Patent No.: US 9,835,973 B2
(45) Date of Patent: Dec. 5, 2017

(54) IMAGE FORMING APPARATUS HAVING CLEANER-LESS DEVELOPER SYSTEM

(71) Applicant: CANON KABUSHIKI KAISHA, Tokyo (JP)

(72) Inventors: Gosuke Goto, Kawasaki (JP); Satoshi Sunahara, Hachioji (JP); Akihisa Matsukawa, Fuchu (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/050,661

(22) Filed: Feb. 23, 2016

(65) Prior Publication Data

US 2016/0252841 A1 Sep. 1, 2016

(30) Foreign Application Priority Data

Feb. 27, 2015 (JP) ..... 2015-038381

(51) Int. Cl.
*G03G 15/00* (2006.01)
*G03G 15/06* (2006.01)
(Continued)

(52) U.S. Cl.
CPC ..... *G03G 15/065* (2013.01); *G03G 15/0812* (2013.01); *G03G 21/0064* (2013.01)

(58) Field of Classification Search
CPC ..... G03G 15/065; G03G 15/5037; G03G 15/0812
(Continued)

(56) References Cited

U.S. PATENT DOCUMENTS 7,379,693 B2 5/2008 Ogawa et al.
9,213,258 B2 12/2015 Goto et al.
(Continued)

FOREIGN PATENT DOCUMENTS

JP 2003-248357 A 9/2003
JP 2005-258345 A 9/2005
(Continued)

OTHER PUBLICATIONS

European Search Report dated Nov. 30, 2016, in related European Patent Application No. 16154423.4.

*Primary Examiner* — Walter L Lindsay, Jr.
*Assistant Examiner* — Jessica L Eley
(74) *Attorney, Agent, or Firm* — Fitzpatrick, Cella, Harper & Scinto

(57) ABSTRACT

An image forming apparatus includes an image bearing member on which a latent image is formed, a developer carrying member for developing the latent image, and an electroconductive regulating member for regulating a layer thickness of the developer in contact with the developer carrying member. A voltage source applies, to the electroconductive regulating member, a voltage of the same polarity as a polarity of the developer on a surface of the developer carrying member at least during a developing operation. The developer remaining on the surface of the image bearing member, after a developer image formed on the image bearing member is transferred, is collected by the developer carrying member. At a time when the developer carrying member is driven in a period other than during the developing operation, a potential difference between the electroconductive regulating member and the developer carrying member is made zero or a voltage which is different toward a side of a polarity opposite the polarity of the developer from a voltage applied to the developer carrying
(Continued)

member is applied to the electroconductive regulating member.

5 Claims, 5 Drawing Sheets

(51) Int. Cl.
*G03G 15/08* (2006.01)
*G03G 21/00* (2006.01)

(58) Field of Classification Search
USPC ..... 399/55, 88, 89, 270, 274, 276
See application file for complete search history.

(56) References Cited

U.S. PATENT DOCUMENTS

2007/0086802 A1* 4/2007 Shin ..... G03G 15/0813 399/55
2007/0248375 A1* 10/2007 Nakazawa ..... G03G 15/065 399/88
2016/0054676 A1 2/2016 Usui et al.

FOREIGN PATENT DOCUMENTS

JP 2005258345 A * 9/2005
JP 2011-145449 A 7/2011
JP 4785407 B2 10/2011

* cited by examiner

IMAGE FORMING APPARATUS HAVING CLEANER-LESS DEVELOPER SYSTEM

FIELD OF THE INVENTION AND RELATED ART

The present invention relates to an image forming apparatus.

Conventionally, in an image forming apparatus, a cleaner-less system (toner recycling system) has been employed in some cases. In this constitution, a cleaning device exclusively for removing a transfer residual toner remaining on a surface of a photosensitive drum after a toner image is transferred from the photosensitive drum onto a recording material by a transfer roller can be eliminated (omitted). Instead, a developing device removes the transfer residual toner on the photosensitive drum through "simultaneous development and cleaning" and collects the transfer residual toner therein and then uses the collected toner again. The simultaneous development and cleaning is a method in which the transfer residual toner on the surface of the photosensitive drum is collected by a fog-removing bias (a fog-removing potential difference Vback which is a potential difference between a DC voltage applied to the developing device and a surface potential of the photosensitive drum) during development in a subsequent step or later. According to this method, a waste (residual) toner can be eliminated and it is possible to reduce a degree of troublesome handling for maintenance. Further, the cleaning device is eliminated and an advantage in terms of a space is large, so that an apparatus main assembly of the image forming apparatus can be considerably downsized.

However, in the case of such a constitution, there was a possibility that the toner is recycled and therefore the developing device is contaminated with powder or the like of the recording material to cause an image defect. That is, the powder or the like was sandwiched between a developing sleeve and a regulating blade to disturb a uniform toner layer and thus there was a possibility that a stripe-shaped image defect generated.

As a type of a developing device to which the cleaner-less system is applied, a one-component magnetic contact developing type has been proposed (Japanese Patent No. 4785407). In the developing device of this type, a magnetic developer (magnetic toner) is carried on a surface of a developing sleeve (developer carrying member) in which a magnetic-field generating means is incorporated, and then is contacted to a surface of a photosensitive drum. According to such a developing device, the magnetic toner is supplied preferentially than the powder of the recording material having a magnetic force. For that reason, compared with the conventional cleaner-less system using a non-magnetic contact developing method, an image inconvenience due to the powder of the recording material does not readily generate.

Further, a method in which a bias (regulating blade bias) is applied to a regulating member and thus electric charges are imparted to the toner has been known. The regulating member includes an electroconductive member and a voltage applying means for applying a DC bias to the electroconductive member, and to the electroconductive member, the regulating blade bias of the same polarity as a polarity of the toner on the surface of the developing sleeve is applied so as to generate a potential difference.

As a result, even when the toner is mixed with the transfer residual toner lowered in triboelectric chargeability by being rubbed and damaged between the photosensitive drum and each of a transfer roller or a charging roller, the electric charge impartment to the toner is promoted, so that a toner charging property on the developing sleeve surface after passing through the regulating member is improved. Then, a deterioration of fog caused due to a toner deterioration by continuous use is suppressed.

However, when a print number of the recording material increases, an amount of the powder of the recording material accumulated inside a developing container continuously increases, so that a state in which the amount of the powder relative to the toner in the developing container is extremely large can be formed. In this state, when printing is effected at a high print ratio, together with the toner, the powder of the recording material is supplied to the developing sleeve. In this case, even when the regulating blade is applied, in the case where the powder of the recording material has a charging property of an opposite polarity to a polarity of the toner, the powder of the recording material is sandwiched at a nip between the regulating member and the developing sleeve by the regulating blade bias, so that a toner layer is disturbed.

SUMMARY OF THE INVENTION

A principal object of the present invention is to provide an image forming apparatus, to which a cleaner-less system is applied, capable of suppressing a phenomenon that powder of a recording material is sandwiched between a regulating member and a developer carrying member to disturb a toner layer in a constitution in which a bias is applied to the regulating member.

According to an aspect of the present invention, there is provided an image forming apparatus comprising: an image bearing member on which a latent image is formed; a developer carrying member for developing the latent image while carrying a developer; an electroconductive regulating member for regulating a layer thickness of the developer in contact with the developer carrying member; and bias applying means for applying, to the regulating member, a bias of the same polarity as a polarity of the developer on a surface of the developer carrying member at least during a developing operation, wherein the developer remaining on the surface of the image bearing member after a developer image formed on the image bearing member is transferred is collected by the developer carrying member, and wherein at timing when the developer carrying member is driven in a period other than during the developing operation, a potential difference between the regulating member and the developer carrying member is made zero or a voltage which is different from a voltage applied to the developer carrying member toward a side of a polarity opposite the polarity of the developer is applied to the regulating member.

According to another aspect of the present invention, there is provided an image forming apparatus comprising: an image bearing member on which a latent image is formed; a developer carrying member for developing the latent image while carrying a developer; an electroconductive regulating member for regulating a layer thickness of the developer in contact with the developer carrying member; bias applying means for applying a bias to the developer carrying member at least during a developing operation; and a Zener diode for providing a potential difference between the regulating member and the developer carrying member, wherein the developer remaining on the surface of the image bearing member after a developer image formed on the image bearing member is transferred is collected by the developer carrying member, and wherein at timing when the developer carrying member is driven in a period other than during the developing operation, the potential difference between the regulating member and the developer carrying member is made zero by the Zener diode.

Further features of the present invention will become apparent from the following description of exemplary embodiments with reference to the attached drawings.

DESCRIPTION OF EMBODIMENTS

Figure 1:
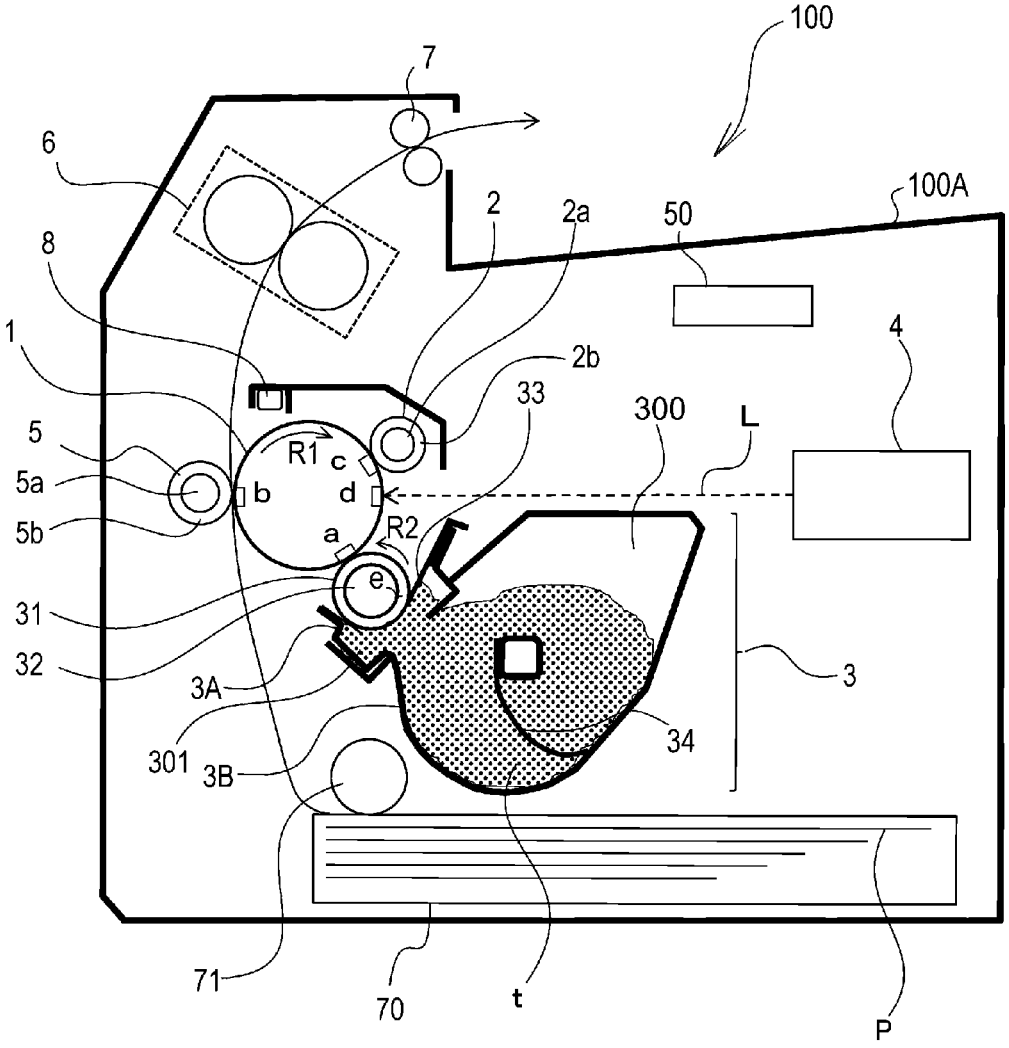
FIG. 1 is a sectional view showing a structure of an image forming apparatus according to Embodiment 1 of the present invention.

Embodiments for carrying out the present invention will be exemplarily described based on specific embodiments in detail with reference to the drawings. However, dimensions, materials, shapes, relative arrangement and the like of constituent elements disclosed in the following embodiments are appropriately changed depending on constitution and various conditions of devices to which the present invention is applied, and therefore, the scope of the present invention is not intended to be limited thereto unless otherwise specified. Incidentally, constituent elements in Embodiment 2 identical to those in Embodiment 1 are represented by the same reference numerals or symbols and will be described in accordance with Embodiment 1.

Embodiment 1

FIG. 1 is a schematic sectional view showing a structure of an image forming apparatus 100 according to Embodiment 1 of the present invention. In this embodiment, as the image forming apparatus 100, a monochromatic laser printer using an electrophotographic process of a transfer type will be described. The image forming apparatus 100 includes an apparatus main assembly 100A.

Inside the apparatus main assembly 100A, a photosensitive drum 1 as an image bearing member, a charging roller 2 as a charging means, a scanner unit 4 as an exposure device, a developing device 3, a transfer roller 5 as a transfer member and a fixing device 6 are provided. Further, the image forming apparatus 100 in this embodiment has a constitution in which a process cartridge prepared by assembling the photosensitive drum 1, the charging roller 2, the developing device 3 and the like into a cartridge is detachably mountable to the apparatus main assembly 100A.

The photosensitive drum in this embodiment is a negatively chargeable OPC photosensitive member of 24 mm in outer diameter. This photosensitive drum 1 is provided rotatably in an arrow R1 direction in the figure at a peripheral speed (=process speed, printing speed) of 167 mm/sec.

The charging roller 2 electrically charges a surface of the photosensitive drum 1. The charging roller 2 is an electroconductive elastic roller and includes a core metal 2*a* and an electroconductive elastic layer 2*b* covering the core metal 2*a*. The charging roller 2 is press-contacted to the photosensitive drum 1 at a predetermined pressure. Of the surface of the photosensitive drum 1, a portion to which the charging roller 2 is press-contacted is a charging portion c.

The image forming apparatus 100 includes a charging voltage source for applying a charging bias to the charging roller 2. The charging voltage source applies a DC voltage to the core metal 2*a* of the charging roller 2. The applied DC voltage is set so that a potential difference between a surface potential of the photosensitive drum 1 and a potential of the charging roller 2 is discharge start voltage or more, and specifically, the DC voltage of −1300 V is applied as the charging bias from the charging voltage source. At this time, the charging roller 2 contact-charges the surface of the photosensitive drum 1 uniformly to a charge potential (dark-portion potential) of −700 V.

The scanner unit 4 includes a laser diode, a polygon mirror and the like. This scanner unit 4 outputs laser light L modulated in intensity correspondingly to a time-series electric digital pixel signal of objective image information, and the charged surface of the photosensitive drum 1 is subjected to scanning exposure to the laser light L. In the case where the charged surface of the photosensitive drum 1 is subjected to whole surface exposure to the laser light L, laser power of the scanning unit 4 is adjusted so that the surface potential of the photosensitive drum 1 is −150 V.

The developing device 3 includes a developing chamber 301 constituted by a first frame 3A and an accommodating chamber 300 constituted by a second frame 3B. In the developing chamber 301, a developing sleeve 31 as a developer carrying member and a regulating blade 33 as a regulating member are provided. In the accommodating chamber 300, a magnetic toner t as a magnetic developer is accommodated. Details of a structure of the developing device 3 will be described later.

The magnetic toner t is attracted to the surface of the developing sleeve 31 by a magnetic force of a magnet roller 32 which is a magnetic field generating means incorporated in the developing sleeve 31. The magnetic toner t is triboelectrically charged to a certain extent. The magnetic toner t visualizes an electrostatic image on the photosensitive drum 1 at a developing portion by a developing bias applied between the developing sleeve 31 and the photosensitive drum 1 by a developing bias applying voltage source. In this embodiment, the developing bias is set at −350 V. The developing portion a is a region, of the surface of the photosensitive drum 1, opposing the developing sleeve 31 and a region where the magnetic developer is supplied by the developing sleeve 31.

As a contact transfer means, the transfer roller 5 having a medium resistance is provided. Of the surface of the photosensitive drum 1, a portion press-contacted to the transfer roller 5 is a transfer portion b. The transfer roller 5 in this embodiment is constituted by a core metal 5*a* and a medium-resistance foam layer 5*b* covering the core metal 5*a*, and had a roller resistance value of $5\times10^{8}\Omega$. A voltage of +2.0 kV was applied to the core metal 5*a*, so that transfer of the toner image as the developer image formed on the photosensitive drum 1 onto a recording material P (paper for example) was effected.

A fixing device 6 heats and presses the recording material P which passed through the transfer portion b and on which the toner image is transferred, and fixes the toner image on the recording material P. Thereafter, the recording material P on which the toner image is fixed is discharged to an outside of the apparatus main assembly 100A.

<Image Forming Process>

An outline of an image forming process will be described with reference to FIG. 1. First, when a print signal is inputted into a controller 50 of the apparatus main assembly 100A, the image forming apparatus 100 starts an image forming operation. Then, at predetermined timing, respective driving portions go into action and voltages are applied. The photosensitive drum 1 rotationally driven is electrically charged uniformly by the charging roller 2. The uniformly charged photosensitive drum 1 is exposed to the laser light L emitted from the scanner unit 4, so that the electrostatic image is formed on the surface of the photosensitive drum 1. Thereafter, the electrostatic image is supplied with the toner (developer) by the developing sleeve 31 and is visualized as the toner image (developer image).

On the other hand, the recording material P is separated and fed from a cassette 70 and is sent to the transfer portion b in synchronism with timing of formation of the toner image on the photosensitive drum 1. In this way, the visualized toner image on the photosensitive drum 1 is transferred onto the recording material by the action of the transfer roller 5. The recording material P on which the toner image is transferred is fed to the fixing device 6. The (unfixed) toner image on the recording material P is permanently fixed on the recording material P by heat and pressure. Thereafter, the recording material P is discharged to an outside of the apparatus main assembly 100A by a discharging roller 7 or the like.

<Cleaner-Less System>

A cleaner-less system will be specifically described. In this embodiment, a so-called cleaner-less system, in which a cleaning member for removing the transfer residual toner, remaining on the photosensitive drum 1 without being transferred, from the photosensitive drum 1 is not provided, is employed.

The transfer residual toner remaining on the photosensitive drum 1 after the transfer step is charged to the negative polarity, similarly as in the case of the photosensitive drum 1, by electric discharge at a gap portion in front of the contact charging portion c. At this time, the surface of the photosensitive drum 1 is charged to −700 V. The transfer residual toner charged to the negative polarity does not deposit on the charging roller 2 and passes through the charging portion c on the basis of a potential difference surface (photosensitive drum 1 surface potential=−700 V, charging roller potential=−1300 V) at the charging portion c.

The transfer residual toner passed through the charging portion c reaches a laser irradiation position d, of the surface of the photosensitive drum 1, where the photosensitive drum surface is irradiated with the laser light L. The transfer residual toner is not so large in amount to the extent that it shields the laser light L of the scanner unit 4, and therefore the transfer residual toner has no influence on the step of forming the electrostatic image on the photosensitive drum 1. Of the toner which passed through the laser irradiation position d, the toner positioned at a non-exposure portion (a photosensitive drum 1 surface which is not subjected to the laser irradiation) is collected on the developing sleeve 31 by an electrostatic force at the developing portion a. Such a toner is collected by the developing device 3 via the developing sleeve 31.

On the other hand, of the toner passed through the laser irradiation position d, the toner positioned at an exposed portion (a photosensitive drum 1 surface subjected to the laser irradiation) is not collected by the electrostatic force and continuously exists on the photosensitive drum 1. However, in some cases, a part of the toner is collected by a physical force due to a peripheral speed difference between the developing sleeve 31 and the photosensitive drum 1. Also such a toner is collected by the developing device 3 via the developing sleeve 31. In this way, the transfer residual toner remaining on the photosensitive drum 1 without being transferred on the recording material P is collected in the main assembly in the developing device 3 except for the toner at the exposure portion. The toner collected in the developing device 3 is mixed with the toner remaining in the developing device 3 and then is used again.

In this embodiment, in order to pass the transfer residual toner through the charging portion c without being deposited on the charging roller 2, the following two constitutions are employed.

First is that a photo-discharging member 8 is provided between the transfer roller 5 and the charging roller 2 with respect to the rotational direction of the photosensitive drum 1 as shown in FIG. 1. The photo-discharging member 8 photo-discharges (removes) the surface potential of the photosensitive drum 1 after passing through the transfer portion b in order to effect stable electric discharge at the charging portion c. By the photo-discharging member 8, the potential of the photosensitive drum 1 before the charging is made about −150 V over an entire longitudinal region, so that uniform discharge can be effected during the charging and thus the transfer residual toner can be uniformly charged to the negative polarity. As a result, the transfer residual toner passes through the charging portion c.

Second is that the charging roller 2 is rotated with a predetermined peripheral speed difference with the photosensitive drum 1. As described above, although most of the toner is charged to the negative polarity by the discharge, the toner which is not completely charged to the negative polarity remains, and is deposited on the charging roller 2 at the charging portion c in some cases. Therefore, by rotating the charging roller 2 and the photosensitive drum 1 with the predetermined peripheral speed difference, such a toner can be charged to the negative polarity by sliding between the charging roller 2 and the photosensitive drum 1.

As a result, an effect of suppressing the deposition of the toner on the charging roller 2 is achieved. In this embodiment, the core metal 2*a* of the charging roller 2 is provided with a charging roller gear, and the charging roller gear engages with a drum gear provided at an end portion of the photosensitive drum 1. Accordingly, with the rotational drive of the photosensitive drum 1, also the charging roller 2 is rotationally driven. A peripheral speed of the surface of the charging roller 2 is set to be 115% of a peripheral speed of the surface of the photosensitive drum 1.

<Developing Device>

Figure 2:
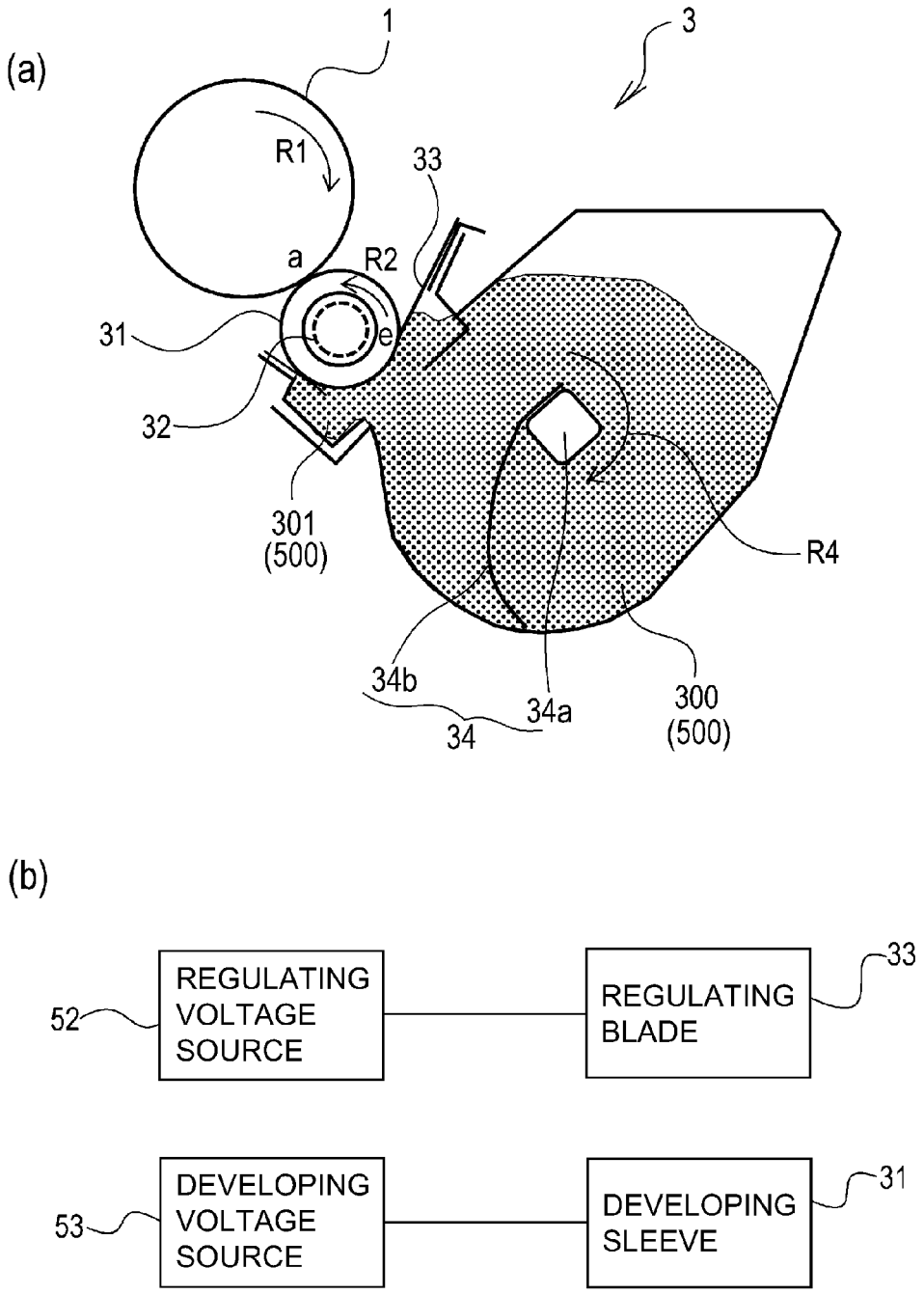
In FIG. 2, (a) is a sectional view of a developing device, and (b) is a block diagram showing a connecting state of a regulating blade and a developing sleeve.

In FIG. 2, (a) is a sectional view of the developing device 3. Referring to (a) of FIG. 2, the developing device 3 for solving the problem of the image forming apparatus 100 employing the cleaner-less system will be described.

The developing device 3 includes a developing container 500. The developing container 500 includes an accommodating chamber 300 for accommodating the toner therein and a developing chamber 301 including the developing sleeve 31. The developing container 500 also collects the toner t remaining on the surface of the photosensitive drum 1 after the developer image formed on the photosensitive drum 1 as the image bearing member on which the latent image is formed is transferred. The toner t is collected by the developing sleeve 31.

The developing sleeve 31 as a developer carrying member is a member for carrying the toner t as the developer and for developing the latent image. The developing sleeve 31 is prepared by forming an about 500 μm-thick electroconductive elastic layer on an outer peripheral surface of a non-magnetic sleeve as a supporting portion formed with a pipe of aluminum or stainless steel. The developing sleeve 31 is supported rotatably in an arrow R2 direction by the developing container 301. The developing sleeve 31 is formed so as to have an outer diameter of 11 mm and a surface roughness Ra (JIS) of an average of 1.5-4.5 μm is general.

The developing sleeve 31 is urged toward the photosensitive drum 1 so as to contact the photosensitive drum 1. The developing sleeve 31 is provided with penetration amount regulating rollers at both end portions thereof with respect to a longitudinal direction (axis direction) thereof. These rollers are contacted to the photosensitive drum 1, so that a penetration amount between the surface of the developing sleeve 31 and the surface of the photosensitive drum 1 is set at a predetermined value.

At one of the end portions of the developing sleeve 31, a developing sleeve gear is fixed, and a driving force is transmitted from a driving source of the apparatus main assembly 100A to the developing sleeve gear via a plurality of gears, so that the developing sleeve 31 is rotationally driven. The developing sleeve 31 rotates in a normal direction with a speed difference of the surface peripheral speed which is 140% of the surface peripheral speed of the photosensitive drum 1. The surface of the developing sleeve 31 has a proper surface roughness so that the developing sleeve 31 can carry and feed the toner in a desired amount.

Inside the developing sleeve 31, the magnet roller 32 is disposed. As the magnet roller 31, a 4-pole magnet roller which is formed in a cylindrical shape having N poles and S poles which are alternately disposed with respect to a circumferential direction was used. The 4 poles includes a developing pole opposing the photosensitive drum 1, a regulating pole opposing the regulating blade 33, a supplying pole for supplying the toner in the developing container 301 to the developing sleeve 31, and a leakage-preventing pole disposed at an opposing portion to a toner leakage-preventing sheet S. Magnetic densities of the respective poles are 70 mT for the regulating pole which is strongest and about 50 mT for other poles. Different from the developing sleeve 31 rotating in the arrow R2 direction, the magnet roller 32 is fixedly disposed inside the developing sleeve 31.

The regulating blade 33 as the regulating member is an electroconductive member for regulating a layer thickness of the toner t in contact with the developing sleeve 31. The regulating blade 33 is contacted at a free end portion thereof to the developing sleeve 31 at a predetermined pressure so that a free end thereof is directed toward an upstream side of the developing sleeve 31 with respect to the rotational direction R2 (counter contact). As a result, the toner attracted to the surface of the developing sleeve 31 by a magnetic force of the magnet roller 32 is regulated in a thin layer and at the same time, the toner is triboelectrically charged to the negative polarity. Further, in this embodiment, for the purpose of suppression of fog, a toner charging property is improved by providing a potential difference the developing sleeve 31 and the regulating blade 33.

The toner supplied with the electric charges at a regulating portion e is fed toward the developing portion to an opposing the surface of the photosensitive drum 1. At the developing portion a, by a potential difference between the surface potential of the photosensitive drum 1 and the potential of the developing sleeve 31, the toner on the developing sleeve 31 is electrostatically deposited on the electrostatic image formed on the surface of the photosensitive drum 1. In this manner, the electrostatic image is developed as the toner image.

The regulating blade 33 includes a supporting member of about 100 μm in thickness for example and a resin layer attached to a free end of the supporting member. The supporting member is an elastic member, and a base end portion thereof is fixed to a supporting metal plate. As a material for the resin layer, an electroconductive resin material is used, and the resin layer includes straight portions formed on a flat surface on a free end side and a base end side. At an intermediary portion between the straight portions, a projected portion projecting toward the developing sleeve 31 is provided. The projected portion is contacted to the surface of the developing sleeve 31 at a predetermined pressure. This contact force (pressure) is about 20 gf/cm to 40 gf/cm (a contact load per 1 cm of the developing sleeve 31 with respect to the longitudinal direction).

In this embodiment, as a material for the supporting member, SUS is used, but phosphor bronze or aluminum alloy may also be used. The supporting member may also be prepared using a resin material having a high hardness if the resin material has electroconductivity. In this embodiment, the resin layer was prepared by coating the supporting member with an electroconductive polyurethane. As other materials, resin materials selected from polyamide, polyamide elastomer, polyester, polyester elastomer, polyester terephthalate, silicone rubber, silicone resin and melamine resin may be used singly or in combination of two or more species. Further, also with respect to the shape of the resin layer, the shape projecting toward the developing sleeve 31 is used, but any shape may also be used and the resin layer may also be omitted.

In FIG. 2, (b) is a block diagram showing a connecting state of each of the regulating blade 33 and the developing sleeve 31. Means for applying biases to the regulating blade 33 and the developing sleeve 31 are independent of each other.

To the regulating blade 33, a regulating (bias) voltage source 52 as a regulating bias applying means is connected. From this regulating voltage source 52, a regulating voltage (regulating bias) which is a predetermined DC voltage is applicable to the regulating blade 33. Further, during a developing operation, the regulating voltage source 52 applies the bias of the same polarity as the charge polarity of the toner t on the surface of the developing sleeve 31 to the regulating blade 33.

To the developing sleeve 31, a developing (bias) voltage source 53 as a developing bias applying means is connected. From this developing voltage source 53, a developing voltage (developing bias) which is a predetermined DC voltage is applicable to the developing sleeve 31. Further, during pre-rotation of the developing operation, the developing voltage source 53 applies the bias to the developing sleeve 31.

From above, in Embodiment 1, in the case where the potential difference between the regulating blade 33 and the developing sleeve 31 is adjusted, the regulating voltage source 52 and the developing voltage source 53 apply the biases.

Specifically, −650 V is applied to the regulating blade 33. As described above, −350 V is applied to the developing sleeve 31. At this time, depending on the potential difference between the developing sleeve 31 and the regulating blade 33, the electric charges move from the regulating blade 33 toward the developing sleeve 31. For that reason, the electric charges flowing from the regulating blade 33 are injected into toner coating on the developing sleeve 31, so that a negatively charging property of the toner is strengthened.

A feeding member 34 is provided rotatably in the accommodating chamber 300 and not only loosens the toner in the accommodating chamber 300 but also feeds the toner to the developing chamber 301. The feeding member 34 is, as shown in (a) of FIG. 2, constituted by a shaft rod member 34*a* provided with a back-up member formed of a resin material and by a PPS film sheet 34*b*. The feeding member 34 rotates in an R4 direction in (a) of FIG. 2 about both end portions thereof as a rotation center. A driving force for rotating the feeding member 34 is obtained in general using a drop in rotational speed from the rotational speed of the above-described developing sleeve gear to a proper rotational speed using a gear train.

In this embodiment, as the toner, a negatively chargeable magnetic one-component toner is used. This toner is prepared by containing 80 wt. parts of magnetic material particles as a main component in 100 wt. parts of a binder resin (styrene-n-butyl acrylate copolymer) and then by incorporating therein a wax or the like, and is 7.5 μm in average particle size. As an example additive, 1.2 wt. parts of silica fine powder is used. In the case where such a toner is used in the developing device 3 having the above-described constitution, a toner coating amount on the developing sleeve 31 is about 0.4 mg/cm$^2$ to about 0.9 mg/cm$^2$.

In such a cleaner-less system, particularly in a constitution in which the toner image is directly transferred from the photosensitive drum 1 onto paper (recording material P) as in this embodiment, in some cases, paper powder or the like resulting from paper deposits on the surface of the photosensitive drum 1 and is collected by the developing device 3. When the paper powder collected by the developing device 3 is sandwiched at the regulating portion e between the regulating blade 33 and the developing sleeve 31, the paper powder disturbs the toner coating on the developing sleeve 31. Here, the regulating portion e refers to a portion (contact portion) where the regulating blade 33 contacts the developing sleeve 31.

In the cleaner-less system constitution, every printing, the paper powder enters the developing container 500, so that an amount of the paper powder in the developing container 500 increases in proportion to a print number. Particularly, in the latter part of a lifetime of a cartridge, a state in which an amount of the toner in the developing container 500 is small and an amount of the paper powder is large is formed. Further, in the case where printing of a high print ratio image is made, the toner is consumed and therefore the toner amount on the developing sleeve 31 becomes small. For that reason, not only most of the toner is supplied to the developing sleeve 31 but also the paper powder is liable to be supplied to the developing sleeve 31. As a result, after the printing of the high print ratio image is made, a state in which the paper powder is liable to be sandwiched at the regulating portion e is formed, so that an image in convenience due to the paper powder is liable to occur.

<Paper Powder Countermeasure Constitution>

Figure 3:
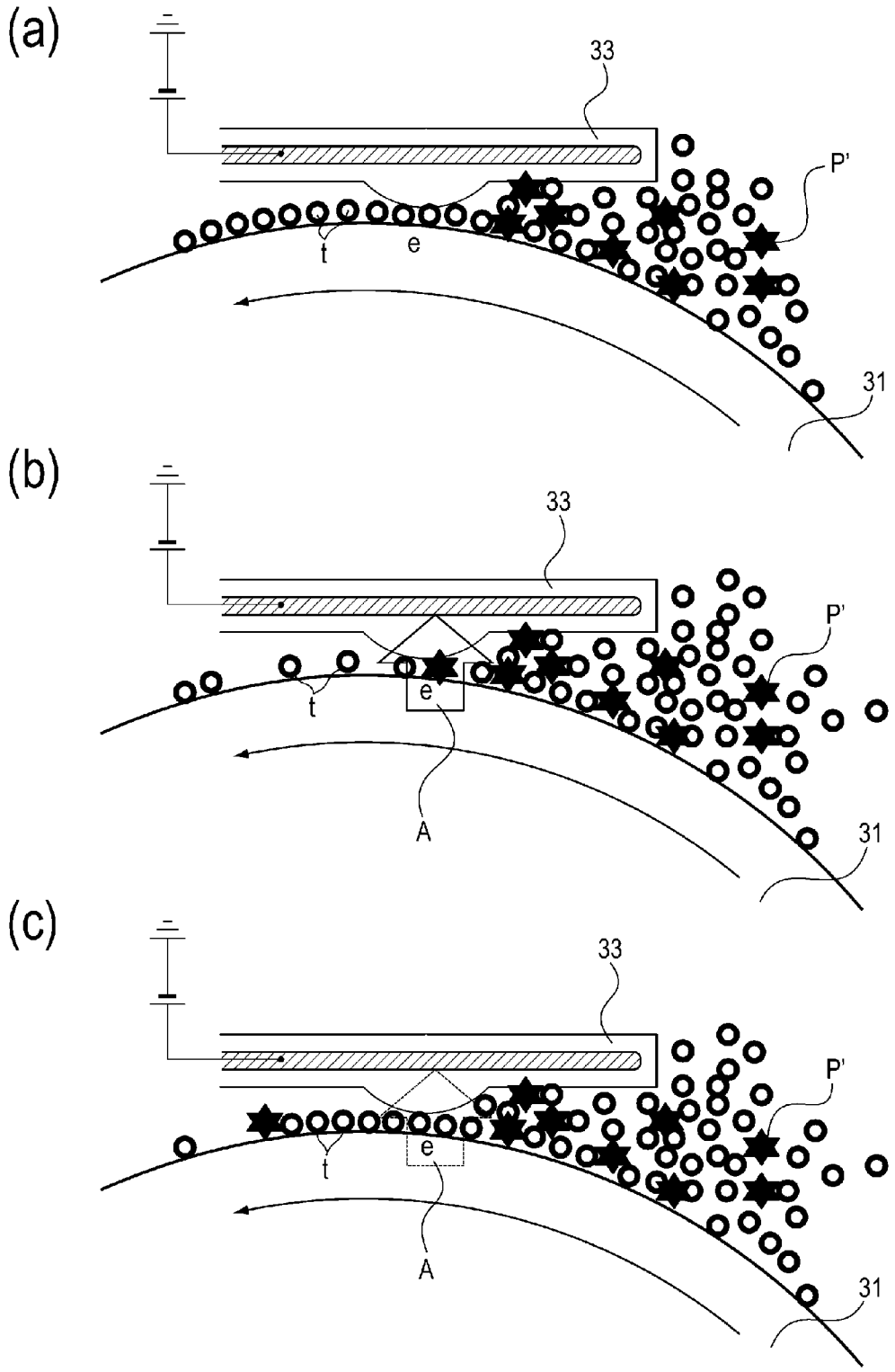
In FIG. 3, (a) to (c) are sectional views showing a phenomenon that powder of a recording material is sandwiched at a position where the regulating blade regulates a layer thickness of a toner on a surface of the developing sleeve.

In FIG. 3, (a) to (c) are sectional views showing a phenomenon that the powder of the recording material P (paper) is sandwiched at a position where the regulating blade 33 regulates the layer thickness of the toner on the surface of the developing sleeve 31. As shown in (a) of FIG. 3, the toner t and powder P' fed to the surface of the developing sleeve 31 by the feeding member 34 ((a) of FIG. 2) are supplied toward the regulating portion e. At this time, most of the powder P' of the recording material P is charged to the positive polarity.

As shown in (b) of FIG. 3, by a potential relationship (regulating bias: −650 V, developing sleeve bias: −350 V) between the regulating blade 33 and the developing sleeve 31, a force in an arrow A direction is exerted. Then, the powder P' of the recording material P was attracted toward the regulating blade 33 side and was sandwiched, so that the powder P' disturbed the layer of the toner t. In order to avoid this, as shown in (c) of FIG. 3, there is a need to study a constitution in which the powder P' of the recording material P is prevented from being sandwiched.

Figure 4:
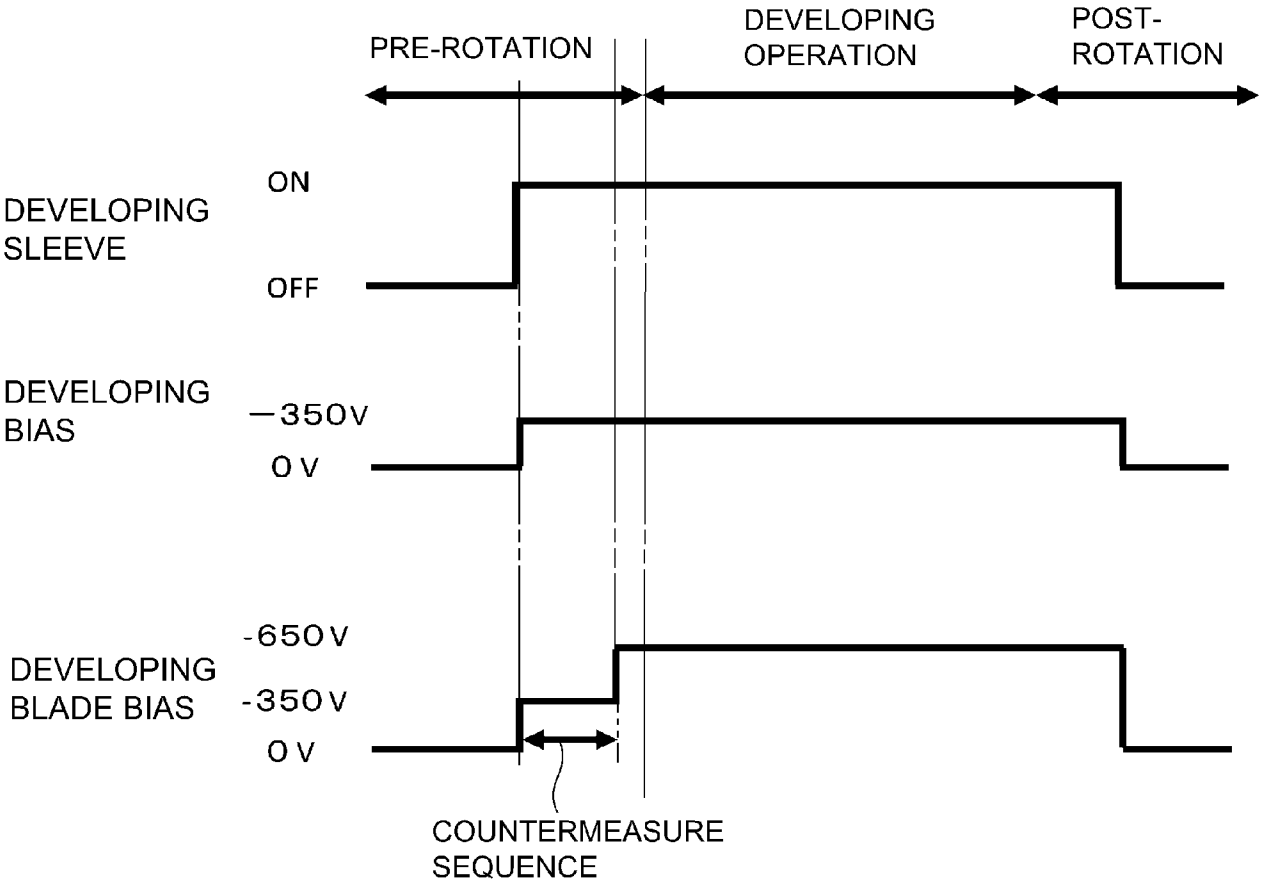
FIG. 4 is a timing chart of drive of the developing sleeve, a developing bias and a regulating blade bias during pre-rotation, a developing operation and post-rotation.

FIG. 4 is a timing chart of drive of the developing sleeve 31, the developing bias and the bias of the regulating blade 33 during pre-rotation, the developing operation and post-rotation. During the pre-rotation of image formation, the drive of the developing sleeve 31 is changed from OFF to ON, so that the developing bias is changed from 0 V to −350 V to be placed in an applied state, and the regulating bias applied to the regulating blade 33 is changed from 0 V to −350 V to be placed in an applied state. That is, at this time, the potential difference between the regulating blade 33 and the developing sleeve 31 is set at 0 V smaller than 650 V which is the potential difference during the developing operation.

This state is maintained for about 0.15 sec which is a rotation period of the developing sleeve 31, and thereafter the sequence goes to the developing operation. At timing when the sequence goes to the developing operation, the bias applied to the regulating blade 33 is switched from −350 V to −650 V.

During the pre-rotation, the potential difference applied between the regulating blade 33 and the developing sleeve 31 is eliminated (removed), so that an electrostatic attraction force is weak (i.e., the force in the arrow A direction is weaker than that during the developing operation shown in (b) of FIG. 3). For that reason, the powder P', of the recording material P, which has been sandwiched at the regulating portion e can be caused to pass through the regulating portion e, so that the disturbed coating of the toner t is restored.

In Embodiment 1, execution timing of a countermeasure sequence of a paper powder problem is during the pre-rotation of the image formation in which the print number is not less than a print number corresponding to 90% of a cartridge yield (cartridge lifetime) at which the toner amount is small and the paper powder amount is large. In this embodiment, the cartridge yield of 5000 sheets, and therefore the countermeasure sequence is carried out at timing of the print number of 4500 sheets or more (later). The print number is stored in an unshown memory of the controller 50 provided in the cartridge.

By performing the countermeasure sequence of the paper powder problem only at necessary timing, it becomes possible to suppress deteriorations of the toner and a functional member such as the developing sleeve 31 by reductions in downtime and traveling distance of the developing sleeve 31. By employing the constitution as described above, it is possible to suppress disturbance of a toner coating state on the developing sleeve 31 caused by the paper powder.

In Embodiment 1, the timing of the countermeasure sequence of the paper powder problem was determined by the print number, but is not limited thereto, and the countermeasure sequence may preferably be carried out in the latter part of the lifetime of the cartridge in which the paper powder amount is not less than a certain amount or a remaining toner amount in the cartridge is not more than a certain amount. For example, at timing when the remaining toner amount is not more than a predetermined (30%) or at later timing, the countermeasure sequence of the paper powder problem may also be executed. Further, as described above, an inconvenience due to the paper powder is liable to generate after the printing of the high print ratio image is made, and therefore the countermeasure sequence may also be executed only after the printing of such an image that the print ratio exceeds 30% for example is made.

In Embodiment 1, the potential difference between the regulating blade 33 and the developing sleeve 31 is made 0, i.e., the potentials of these members are the same, but the present invention is not limited thereto. The potential relationship between these members may only be required that a force for attracting the paper powder of the positive polarity to the regulating blade 33 is weakened. For example, while maintaining a magnitude relationship between the regulating bias and the developing bias, the potential difference may also be made small. Specifically, the regulating bias of −500 V and the developing bias of −350 may also be used. From the above, the controller 50 can be said that it sets the potential difference between the regulating blade 33 and the developing sleeve 31 at a potential difference lower than the potential difference during the developing operation at timing, other than the developing operation, when the developing sleeve 31 is driven.

Further, the magnitude relationship between the regulating bias and the developing bias may also be reversed. For example, the regulating bias of −150 V and the developing bias of −350 may also be used. This can be said that a voltage of an opposite polarity to the charge polarity of the toner t on the surface of the developing sleeve 31 is applied to the regulating blade 33. This means that in (b) of FIG. 3, a force is applied to the powder P' of the recording material P in an opposite direction to the arrow A direction. Further, the application of the voltage of the opposite polarity to the charge polarity of the toner t on the surface of the developing sleeve 31 to the regulating blade 33 includes, in the above-described cases, not only the case where a positive bias such as +300 V is applied to the regulating blade 33 but also the case where a bias of −150 V which is positive relative to the developing bias of −350 V applied to the developing sleeve 31.

In Embodiment 1, an execution time of the countermeasure sequence of the paper powder problem is about 0.15 sec which is the rotation period of the developing sleeve 31. However, the execution time is not limited thereto when the execution time is not less than a sum of a response time of switching of the bias applied to the regulating blade 33 and a passing time of the developing sleeve 31 through the regulating portion e of the regulating blade 33.

Specifically, the time in which the potential difference between the regulating blade 33 and the developing sleeve 31 is made smaller than that during the developing operation or in which the voltage of the opposite polarity to the charge polarity of the toner t on the surface of the developing sleeve 31 is applied to the regulating blade 33 may preferably be the following time. That is, the time may desirably be not less than a sum of a response time in which the regulating voltage source 52 responds after receiving a switching signal and a required movement time required for movement of a predetermined position of the developing sleeve 31 from a front of a contact position between the developing sleeve 31 and the regulating blade 33 to a rear of the contact position immediately before the response time.

In Embodiment 1, the countermeasure sequence of the paper powder problem is carried out during the pre-rotation of the image formation, but the present invention is not limited thereto. The countermeasure sequence may only be required to be carried out in a period other than during the developing operation. For example, the countermeasure sequence may also be carried out during a paper (sheet) interval of continuous printing or during the post-rotation of the image formation.

Accordingly, the above-described period other that during the developing operation may only be required to include at least one of the pre-rotation in which the developer carrying member is rotated before the developing operation and the post-rotation in which the developer carrying member is rotated after the developing operation. Further, in the case where the period other than during the developing operation is the pre-rotation, the voltage applied from the regulating voltage source 52 to the regulating blade 33 is changed and set from 0 V to a voltage smaller in absolute value than that during the developing operation (FIG. 4). In the case where the period other than during the developing operation is the post-rotation, the voltage applied from the regulating voltage source 52 to the regulating blade 33 is changed and set from the voltage applied during the developing operation to a voltage smaller in absolute value than the voltage applied during the developing operation (not shown in FIG. 4).

In Embodiment 1, an example in which an inconvenience (problem) caused due to the paper powder is solved by the execution of the countermeasure sequence of the paper powder problem in the image forming apparatus 100 employing the magnetic contact developing type is described. However, if an image forming apparatus 100 in which the cleaner-less system is employed and the bias of the same polarity as the charge polarity of the toner is applied to the regulating blade 33 during the developing operation is used, a similar effect can be expected even in the type other than the contact developing type. For example, the similar effect can be expected also in the case where the image forming apparatus employs a non-magnetic contact developing type.

In Embodiment 1, the paper is used as the recording material P, and therefore the problem caused due to the paper powder is described, but the present invention is not limited thereto. For example, also with respect to a problem generated due to a foreign matter such as a powder generated in the case where a plastic sheet or the like is used as the recording material P, an effect can be obtained by employing the constitution of the present invention.

Embodiment 2

Figure 5:
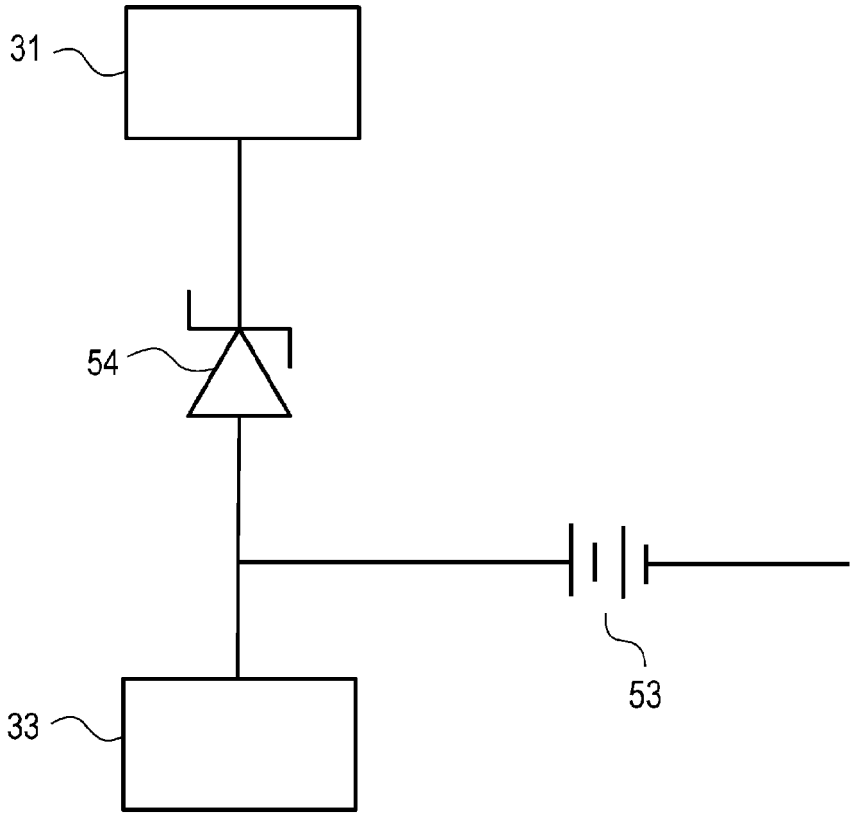
FIG. 5 is a schematic view showing a method of forming a potential difference between a regulating blade and a developing sleeve in Embodiment 2.

FIG. 5 is a schematic view showing a method of forming a potential difference between a regulating blade 33 and a developing sleeve 31 in Embodiment 2. A constitution of a developing device in this embodiment is the same as the constitution of the developing device in Embodiment 1 except that a bias applying constitution to the regulating blade 33 and the developing sleeve 31 is different from that in Embodiment 1, and therefore will be omitted from detailed description.

In this embodiment, Zener diode 54 is used as a common voltage applying means, so that a potential difference is provided between the developing sleeve 31 and the regulating blade 33. The Zener diode 43 is connected between the regulating blade 33 and the developing sleeve 31. The developing (bias) voltage source 53 is connected between the developing sleeve 31 and the Zener diode 54 so that a bias can be applied from the developing voltage source 53 to the developing sleeve 31. The Zener diode 54 provides the potential difference between the regulating blade 33 and the developing sleeve 31 during the developing operation. For example, −650 V is applied to the regulating blade 33, and −350 V is applied to the developing sleeve 31.

In this embodiment, the voltage source is referred to as the developing voltage source 53 but may also be regarded as the regulating (bias) voltage source 52. In other words, two voltage sources are needed in Embodiment 1, whereas a single voltage source may only be required to be used in this embodiment.

In a circuit constitution in this embodiment, when the developing bias is outputted, a predetermined potential difference is provided between the regulating blade 33 and the developing sleeve 31. For that reason, the inconvenience caused due to the paper powder is suppressed by performing the following countermeasure sequence of the paper powder problem.

That is, the controller 50 makes the potential difference between the regulating blade 33 and the developing sleeve 31 zero by the Zener diode 54 at timing, other than during the developing operation, when the developing sleeve 31 is driven. Specifically, during the pre-rotation, the developing bias is made 0 V for about 0.15 sec. During the pre-rotation, not only the developing bias but also the regulating bias become 0 V, so that the potential difference between the developing sleeve 31 and the regulating blade 33 is eliminated (removed). As a result, the paper powder sandwiched at the regulating portion e can be caused to pass through the regulating portion e, so that the disturbed toner coating is restored.

The time in which the potential difference between the regulating blade 33 and the developing sleeve 31 is made zero by the Zener diode 54 may preferably be the following time. That is, the time may desirably be not less than a sum of a response time in which the developing voltage source 53 responds after receiving a switching signal and a required movement time required for movement of a predetermined position of the developing sleeve 31 from a front of a contact position between the developing sleeve 31 and the regulating blade 33 to a rear of the contact position immediately before the response time.

In this embodiment, the countermeasure sequence of the paper powder problem can be carried out only by the developing voltage source 53. For that reason, compared with Embodiment 1 requiring the regulating voltage source 52 and the developing voltage source 53, downsizing of the apparatus main assembly 100A and reduction in product cost can be realized.

According to the constitution of Embodiment 1 or Embodiment 2, in the constitution in which the cleaner-less system is employed and in which the bias is applied to the regulating blade 33, a phenomenon that the powder P' of the recording material P collected in the developing container 500 is sandwiched between the regulating blade 33 and the developing sleeve 31 and thus disturbs the toner layer can be suppressed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-038381 filed on Feb. 27, 2015, which is hereby incorporated by reference herein in its entirety.

What is claimed is:

1. An image forming apparatus comprising:

an image bearing member on which a latent image is formed;

a developer carrying member for carrying a developer and developing the latent image;

an electroconductive regulating member for regulating a layer thickness of the developer in contact with said developer carrying member; and a voltage source applying, to said electroconductive regulating member, a voltage of the same polarity as a polarity of the developer on a surface of said developer carrying member at least during a developing operation, wherein the developer remaining on the surface of said image bearing member, after a developer image formed on said image bearing member is transferred, is collected by said developer carrying member, and wherein at a time when said developer carrying member is driven in a period other than during the developing operation, a potential difference between said electroconductive regulating member and said developer carrying member is made zero, or a DC voltage, which has the same polarity as the polarity of the developer and has a smaller magnitude than a voltage applied to said developer carrying member or which has a polarity opposite from the polarity of the developer, is applied to said electroconductive regulating member.

2. An image forming apparatus according to claim 1, wherein a time in which the potential difference between said electroconductive regulating member and said developer carrying member is made zero or in which the DC voltage, which has the same polarity as the polarity of the developer and has a smaller magnitude than a voltage applied to said developer carrying member or which has a polarity opposite from the polarity of the developer, is applied to said electroconductive regulating member, is not less than a sum of a response time in which said voltage source responds after receiving a switching signal and a required movement time required for movement of a predetermined position of said developer carrying member from a front of a contact position between said developer carrying member and said electroconductive regulating member to a rear of the contact position immediately before an end of the response time.

3. An image forming apparatus according to claim 1, wherein the period other than during the developing operation includes at least one of a period of pre-rotation in which said developer carrying member is rotated before the developing operation and a period of post-rotation in which said developer carrying member is rotated after the developing operation.

4. An image forming apparatus comprising:

an image bearing member on which a latent image is formed;

a developer carrying member for developing the latent image while carrying a developer;

an electroconductive regulating member for regulating a layer thickness of the developer in contact with said developer carrying member;

voltage source for applying a bias to said developer carrying member at least during a developing operation; and a Zener diode for providing a potential difference between said electroconductive regulating member and said developer carrying member, wherein the developer remaining on the surface of said image bearing member, after a developer image formed on said image bearing member is transferred, is collected by said developer carrying member, wherein a time when said developer carrying member is driven in a period other than during the developing operation, the potential difference between said electroconductive regulating member and said developer carrying member is made zero by said Zener diode, and wherein a time in which the potential difference between said electroconductive regulating member and said developer carrying member is made zero by said Zener diode is not less than a sum of a response time in which said voltage source responds after receiving a switching signal and a required movement time required for movement of a predetermined position of said developer carrying member from a front of a contact position between said developer carrying member and said electroconductive regulating member to a rear of the contact position immediately before an end of the response time.

5. An image forming apparatus according to claim 4, wherein the period other than during the developing operation includes at least one of a period of pre-rotation in which said developer carrying member is rotated before the developing operation and a period of post-rotation in which said developer carrying member is rotated after the developing operation.

* * * * *